US012169103B2

(12) United States Patent
Sugimura et al.

(10) Patent No.: US 12,169,103 B2
(45) Date of Patent: Dec. 17, 2024

(54) HEAT EXCHANGER

(71) Applicant: DENSO CORPORATION, Kariya (JP)

(72) Inventors: Ryohei Sugimura, Kariya (JP); Hiroshi Mieda, Kariya (JP)

(73) Assignee: DENSO CORPORATION, Kariya (JP)

( * ) Notice: Subject to any disclaimer, the term of this patent is extended or adjusted under 35 U.S.C. 154(b) by 224 days.

(21) Appl. No.: 17/965,095

(22) Filed: Oct. 13, 2022

(65) Prior Publication Data

US 2023/0029816 A1 Feb. 2, 2023

Related U.S. Application Data

(63) Continuation of application No. PCT/JP2021/014338, filed on Apr. 2, 2021.

(30) Foreign Application Priority Data

Apr. 17, 2020 (JP) ..... 2020-074064

(51) Int. Cl.

| | |
|---|---|
| ***F28F 1/10*** | (2006.01) |
| ***F25B 39/04*** | (2006.01) |
| ***F28D 21/00*** | (2006.01) |
| ***F28F 9/02*** | (2006.01) |

(52) U.S. Cl.

CPC ..... *F28F 9/0221* (2013.01); *F25B 39/04* (2013.01); *F28D 21/00* (2013.01); *F28D 2021/0084* (2013.01)

(58) Field of Classification Search

CPC ..... F28F 9/0221; F25B 39/04; F28D 21/00; F28D 21/0084

USPC ..... 165/172

See application file for complete search history.

(56) References Cited

U.S. PATENT DOCUMENTS

| | | | |
|---|---|---|---|
| 2013/0074340 | A1 | 3/2013 | Hirayama et al. |
| 2020/0116431 | A1 | 4/2020 | Mieda et al. |

FOREIGN PATENT DOCUMENTS

| | | | | |
|---|---|---|---|---|
| CN | 1585879 | A | * | 2/2005 |
| DE | 19961199 | A1 | | 6/2001 |
| DE | 112018002987 | T5 | | 2/2020 |
| JP | 2005172357 | A | | 6/2005 |
| JP | 2007327654 | A | | 12/2007 |
| JP | 2010169289 | A | * | 8/2010 |
| JP | 2013072607 | A | | 4/2013 |
| JP | 2019002609 | A | | 1/2019 |

* cited by examiner

*Primary Examiner* — Davis D Hwu

(74) *Attorney, Agent, or Firm* — Harness, Dickey & Pierce, P.L.C.

(57) ABSTRACT

The heat exchanger includes a first heat-exchange portion and a second heat-exchange portion. The first heat-exchange portion includes a first header tank having an inflow portion through which the heat medium flows into the first heat-exchange portion. The second heat-exchange portion includes a second header tank having an outflow portion through which the heat medium flows out of the second heat-exchange portion. The first header tank and the second header tank are connected to each other via a connecting portion. The connecting portion has a slit passing through the connecting portion.

6 Claims, 15 Drawing Sheets

HEAT EXCHANGER

CROSS REFERENCE TO RELATED APPLICATIONS

The present application is a continuation application of International Patent Application No. PCT/JP2021/014338 filed on Apr. 2, 2021, which designated the U.S. and claims the benefit of priority from Japanese Patent Application No. 2020-074064 filed on Apr. 17, 2020. The entire disclosures of all of the above applications are incorporated herein by reference.

TECHNICAL FIELD

The present disclosure relates to a heat exchanger.

BACKGROUND

A heat exchanger exchanges heat between a refrigerant flowing inside it and air flowing outside it.

SUMMARY

According to at least one of embodiment, a heat exchanger for heat exchange between heat medium flowing inside the heat exchanger and air flowing outside the heat exchanger. The heat exchanger includes a first heat-exchange portion and a second heat-exchange portion that are arranged facing each other in an air flow direction, and are connected to allow the heat medium to flow between the first heat-exchange portion and the second heat-exchange portion. The first heat-exchange portion includes a first core having a stacked structure of tubes through which the heat medium flows, and a first header tank connected to ends of the tubes of the first core and having an inflow portion through which the heat medium flows into the first heat-exchange portion. The second heat-exchange portion includes a second core having a stacked structure of tubes through which the heat medium flows, and a second header tank connected to ends of the tubes of the second core and having an outflow portion through which the heat medium flows out of the second heat-exchange portion. The first header tank allows a gas-phase heat medium to flow through the first header tank. The second header tank allows a liquid-phase heat medium to flow through the second header tank. The liquid-phase heat medium is lower in temperature than the gas-phase heat medium flowing through the first header tank. The first header tank and the second header tank are connected to each other via a connecting portion. The connecting portion has a slit passing through the connecting portion.

BRIEF DESCRIPTION OF DRAWINGS

The details of one or more embodiments are set forth in the accompanying drawings and the description below. Other features and advantages will be apparent from the description and drawings, and from the claims.

DETAILED DESCRIPTION

Figure 1:
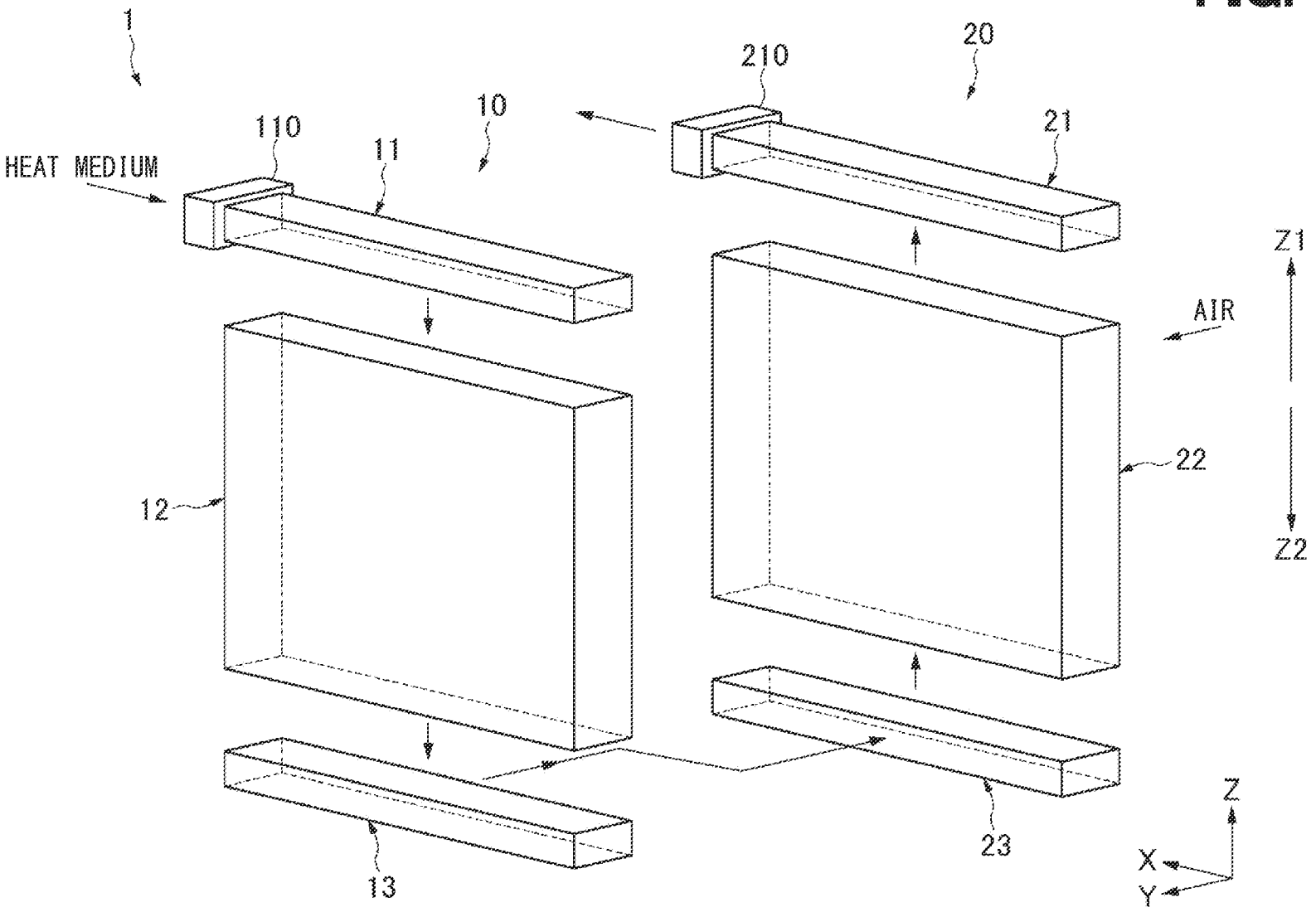
FIG. 1 is a diagram schematically illustrating a configuration of a heat exchanger according to a first embodiment.

To begin with, examples of relevant techniques will be described. A heat exchanger according to a comparative example exchanges heat between a refrigerant flowing inside it and air flowing outside it. This heat exchanger includes a first heat-exchange portion and a second heat-exchange portion which are arranged in series in an air flow direction. Each of the first heat-exchange portion and the second heat-exchange portion has a core formed by stacking tubes through which the refrigerant flows, and a header tank connected to ends of the tubes. The header tank of each heat-exchange portion has a tube joint portion to which the tubes are joined, and a tank main body which forms an internal space of the tank together with the tube joint portion. The tube joint portions of the heat-exchange portions are integrally formed. Therefore, in the heat exchanger, the header tanks of the heat-exchange portions are connected to each other.

When the heat exchanger is used, for example, as a condenser in a heat pump cycle, a high-temperature and gas-phase heat medium flows into the header tank of the first heat-exchange portion. The gas-phase heat medium that has flowed into the header tank of the first heat-exchange portion exchanges heat with the air when flowing through the core of the first heat-exchange portion and the core of the second heat-exchange portion. As a result, the heat of the heat medium is absorbed by the air and the air is heated. In the heat pump cycle, the heated air is blown into, for example, a vehicle compartment, thereby heating the vehicle compartment. The gas-phase heat medium gradually lowers in temperature due to heat exchange with the air, and transitions to a liquid-phase heat medium. The low-temperature and liquid-phase heat medium is collected in the header tank of the second heat-exchange portion and then discharged to an outside.

Thus, when the heat exchanger is used as a condenser, the header tank of the first heat-exchange portion through which the high-temperature and gas-phase heat medium flows is thermally deformed in an expanding direction, while the header tank of the second heat-exchange portion through which the low-temperature and liquid-phase heat medium flows is thermally deformed in an shrinking direction. As a result, an entirety of the first header tank and the second header tank may be thermally deformed into an arch shape. When the first and second header tanks deform due to thermal strain in this manner, a stress is generated in the tubes connected to the header tanks. It has been confirmed by the present inventors' simulation analysis that such stress tends to be concentrated particularly at the ends of the tubes located inside the header tank. Concentration of stress at the ends of the tubes may deform the tubes or, in a worse case, lead to breakage of the tubes.

In contrast, according to one aspect of the present disclosure, a heat exchanger is used for heat exchange between heat medium flowing inside the heat exchanger and air flowing outside the heat exchanger. The heat exchanger includes a first heat-exchange portion and a second heat-exchange portion that are arranged facing each other in an air flow direction, and are connected to allow the heat medium to flow between the first heat-exchange portion and the second heat-exchange portion. The first heat-exchange portion includes a first core having a stacked structure of tubes through which the heat medium flows, and a first header tank connected to ends of the tubes of the first core and having an inflow portion through which the heat medium flows into the first heat-exchange portion. The second heat-exchange portion includes a second core having a stacked structure of tubes through which the heat medium flows, and a second header tank connected to ends of the tubes of the second core and having an outflow portion through which the heat medium flows out of the second heat-exchange portion. The first header tank allows a gas-phase heat medium to flow through the first header tank. The second header tank allows a liquid-phase heat medium to flow through the second header tank. The liquid-phase heat medium is lower in temperature than the gas-phase heat medium flowing through the first header tank. The first header tank and the second header tank are connected to each other via a connecting portion. The connecting portion has a slit passing through the connecting portion.

According to this configuration, the heat medium flowing into the first header tank from the inflow portion exchanges heat with the air in the first core and the second core, and then flows into the second header tank. Thus, temperatures of the heat medium flowing through the first and second header tanks are different. Therefore, the above-described thermal strain occurs in the first header tank and the second header tank. At this time, in the above configuration, when the header tanks are deformed due to the thermal strain, the slit of the connecting portion is capable of absorbing a difference in amount of deformation between the header tanks in the air flow direction. Moreover, since the slit is provided in the connecting portion, deformation of the header tanks in the longitudinal direction of the tubes is allowed. As a result, the tubes are less likely to be restrained by the header tanks in the longitudinal direction of the tubes. In this way, the difference in amount of deformation between the header tanks is absorbed by the slit of the connecting portions, and the tubes are less likely to be restrained by the header tanks. As a result, even when the header tanks are deformed due to thermal strain, a stress is less likely to occur in the tubes. Therefore, stress concentration in the tubes can be reduced.

Hereinafter, an embodiment of a heat exchanger will be described with reference to the drawings. To facilitate understanding, identical constituent elements are assigned identical numerals in the drawings, and the duplicate descriptions will be omitted.

First Embodiment

First, a heat exchanger 1 according to a first embodiment shown in FIG. 1 will be described.

The heat exchanger 1 shown in FIG. 1 can be used, for example, as an indoor condenser which is one of components of a heat pump cycle of an air conditioner mounted on a vehicle. The air conditioner is a device that heats or cools an air flowing through an air conditioning duct and blows the air into a vehicle compartment, thereby heating or cooling the vehicle compartment. The heat pump cycle includes an expansion valve, an indoor evaporator, an outdoor heat exchanger, and a compressor in addition to the indoor condenser. The heat exchanger 1 as the indoor condenser is arranged in the air conditioning duct, and performs heat exchange between a heat medium flowing through the heat exchanger 1 and the air flowing through the air conditioning duct. As a result, the heat exchanger 1 is used as a part that heats the air by absorbing heat from the heat medium into the air.

Next, a specific configuration of the heat exchanger 1 will be described.

As shown in FIG. 1, the heat exchanger 1 includes a leeward heat-exchange portion 10 and a windward heat-exchange portion 20. The heat exchanger 1 is made of a material such as an aluminum alloy. The leeward heat-exchange portion 10 and the windward heat-exchange portion 20 are arranged facing each other in an air flow direction Y. The leeward heat-exchange portion 10 is arranged downstream in the air flow direction Y from the windward heat-exchange portion 20. In the present embodiment, the leeward heat-exchange portion 10 corresponds to a first heat-exchange portion, and the windward heat-exchange portion 20 corresponds to a second heat-exchange portion.

A Z-axis direction orthogonal to the air flow direction Y shown in FIG. 1 is a vertical direction Z. Hereinafter, an upward direction in the vertical direction Z is referred to as an "upward vertical direction Z1", and a downward direction in the vertical direction Z is referred to as a "downward vertical direction Z2". Further, a direction orthogonal to both the air flow direction Y and the vertical direction Z is referred to as an X-axis direction.

The leeward heat-exchange portion 10 includes a leeward first tank 11, a leeward core 12 and a leeward second tank 13. The leeward first tank 11, the leeward core 12, and the leeward second tank 13 are arranged in this order in the downward vertical direction Z2.

Figure 2:
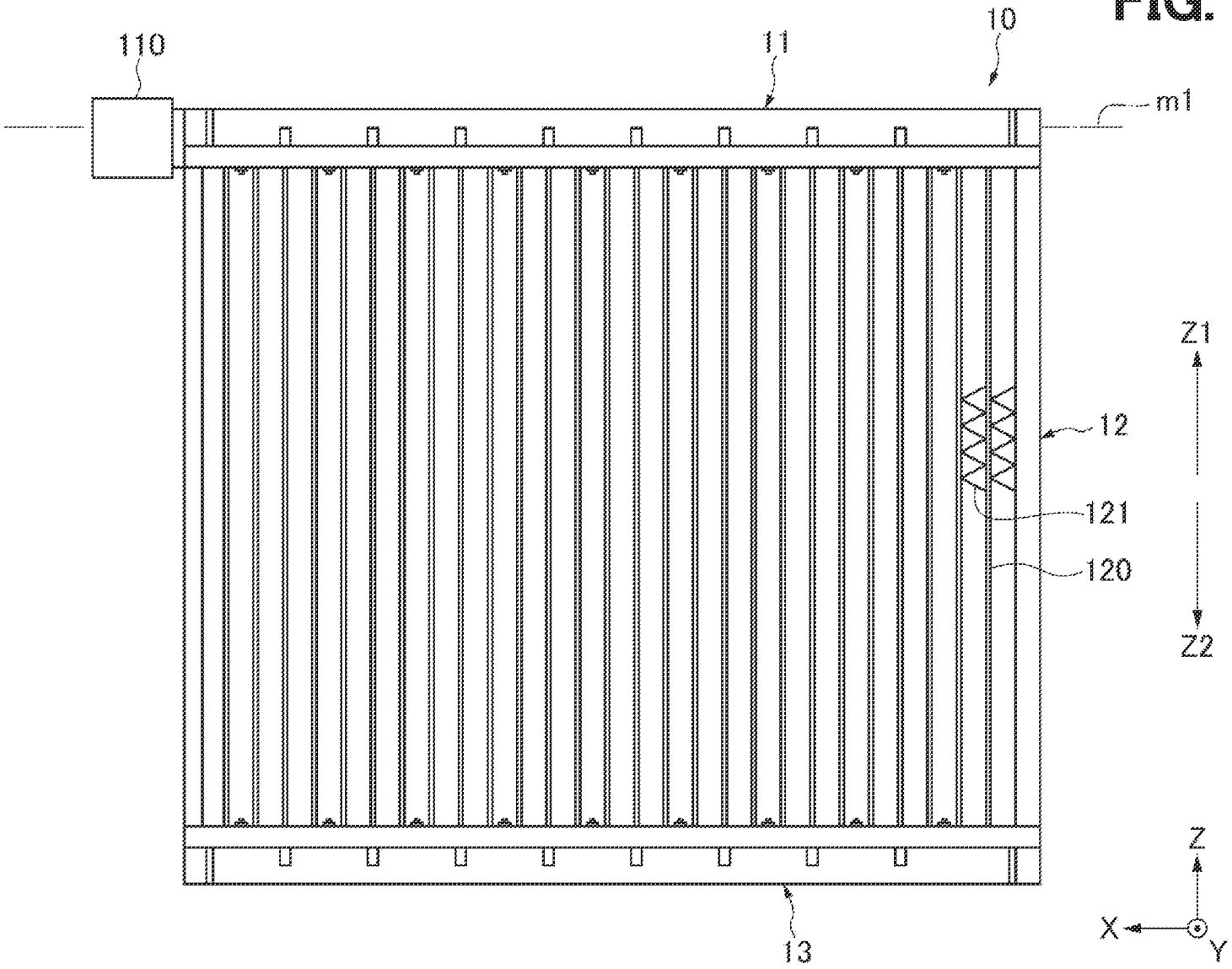
FIG. 2 is a front view illustrating a front structure of the heat exchanger of the first embodiment.

As shown in FIG. 2, the leeward core 12 has a stacking structure in which tubes 120 and fins 121 are alternately arranged. In the present embodiment, the leeward core 12 corresponds to a first core.

Each tube 120 is a member having a flat shape in a cross-section perpendicular to the vertical direction Z. The tubes 120 are stacked with each other in the X-axis direction at predetermined intervals. Each tube 120 extends in the vertical direction Z. An internal space of each tube 120 constitutes a flow path through which the heat medium flows. Air flows through gaps defined between the adjacent ones 120, 120 of the tubes 120 in a direction indicated by an arrow Y.

The fins 121 are arranged in the gaps defined between adjacent ones 120, 120 of the tubes 120. Each fin 121 is a so-called corrugated fin formed by bending a thin metal plate into a wavy shape. Peaks of a bent portion of the fin 121 are joined to an outer wall of a tube 120 by brazing. The fins 121 increase a heat transfer area exposed to air flowing outside the tubes 120.

The leeward first tank 11 is provided at an upper end of the leeward core 12. The leeward first tank 11 has a cylindrical shape centered at an axis m1. The axis m1 is parallel to the X-axis direction. The leeward first tank 11 extends in the X-axis direction. The leeward first tank 11 is connected to an upper end of each of the tubes 120 of the leeward core 12. An inflow portion 110 is attached to one end of the leeward first tank 11 in the X-axis direction. The inflow portion 110 functions as a connector to which a pipe can be connected, and allows the heat medium supplied through the pipe to flow into the leeward first tank 11. In the present embodiment, the leeward first tank 11 corresponds to a first header tank.

The leeward second tank 13 is provided at a lower end of the leeward core 12. The leeward second tank 13 has a cylindrical shape similar to the leeward first tank 11. The leeward second tank 13 is connected to a lower end of each of the tubes 120 of the leeward core 12.

Figure 3:
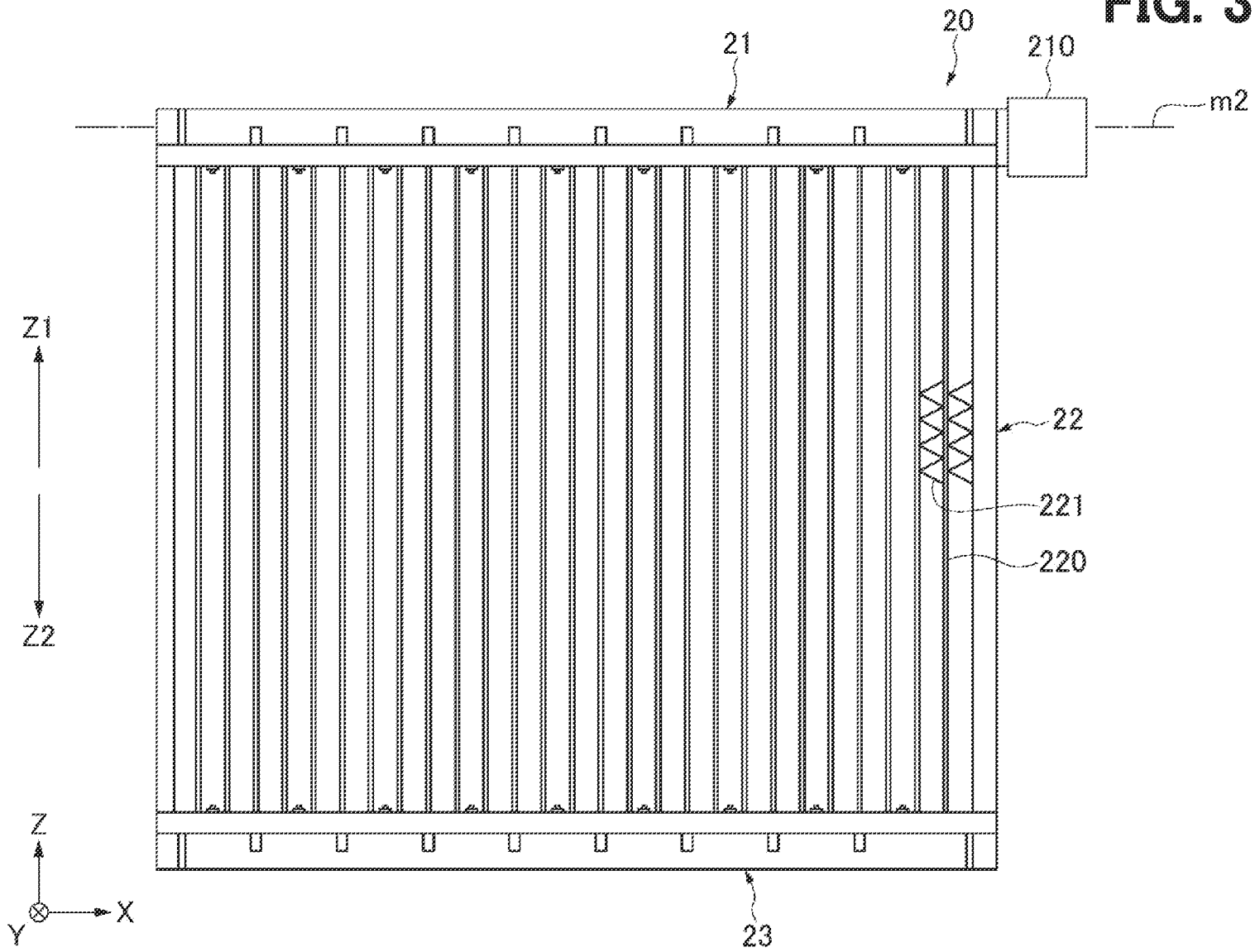
FIG. 3 is a back view illustrating a back structure of the heat exchanger of the first embodiment.

As shown FIG. 1, the windward heat-exchange portion 20 includes a windward first tank 21, a windward core 22 and a windward second tank 23. The windward first tank 21, the windward core 22, and the windward second tank 23 are arranged in this order in the downward vertical direction Z2. As shown in FIG. 3, the windward core 22 includes tubes 220 and fins 221. In the present embodiment, the windward core 22 corresponds to a second core.

Since a structure of each element constituting the windward heat-exchange portion 20 is basically the same as a structure of a corresponding element of the leeward second tank 13, detailed descriptions thereof will be omitted. However, an outflow portion 210, instead of the inflow portion 110, is attached to one end of the windward first tank 21 in the X-axis direction. The outflow portion 210 functions as a connector to which a pipe can be connected, and allows the heat medium collected inside the windward first tank 21 to flow out of the windward first tank 21 through the pipe. In the present embodiment, the windward first tank 21 corresponds to a second header tank. A reference sign m2 shown in FIG. 3 indicates a central axis of the windward first tank 21.

An internal space of the leeward second tank 13 and an internal space of the windward second tank 23 communicate with each other directly or indirectly via a pipe, another tank, or the like. Therefore, the heat medium flowing through the internal space of the leeward second tank 13 is capable of flowing through the internal space of the windward second tank 23. Thus, in the heat exchanger 1 of the present embodiment, the leeward heat-exchange portion 10 and the windward heat-exchange portion 20 are connected so that the heat medium is capable of flowing therebetween.

Figure 4:
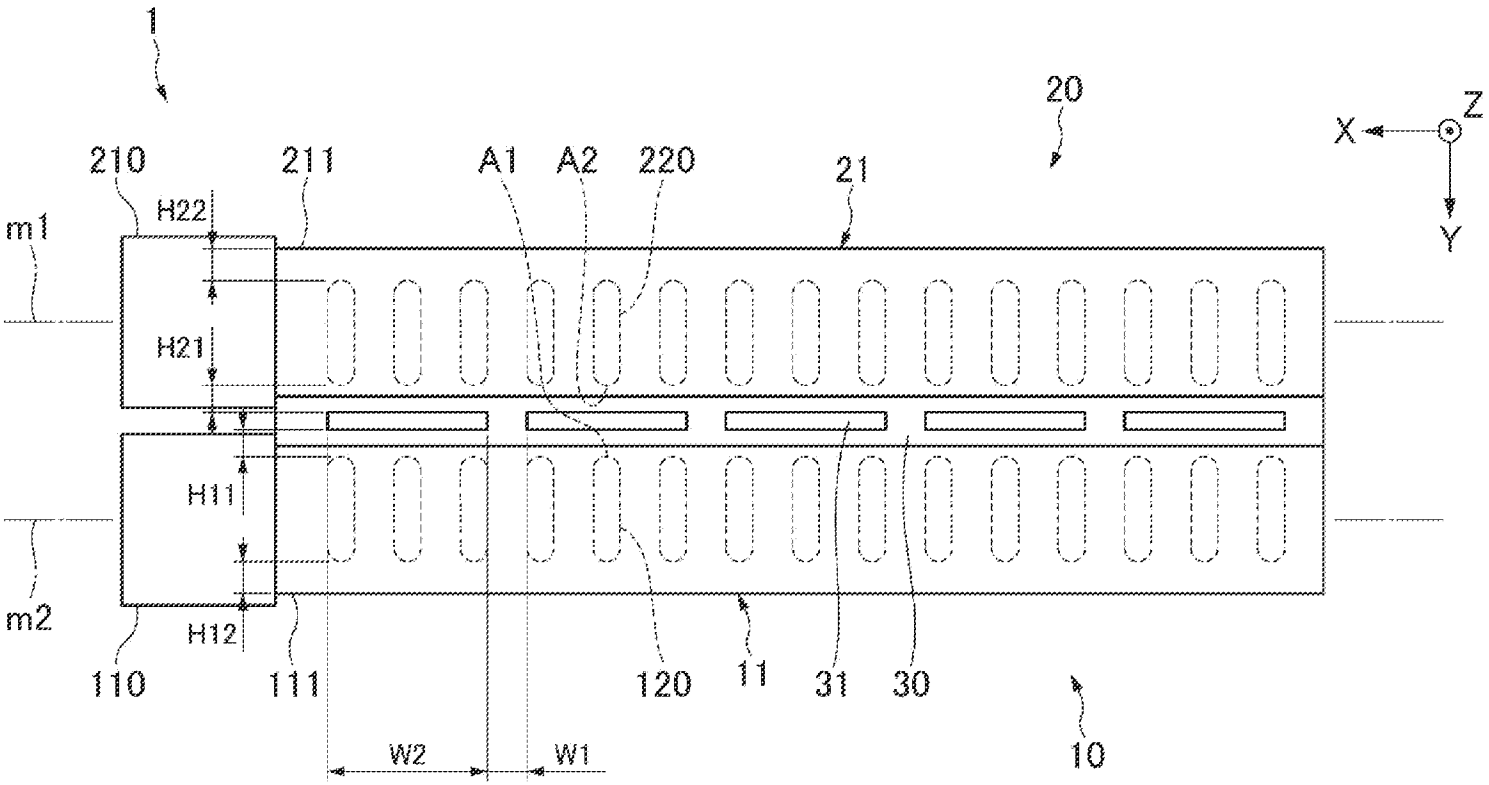
FIG. 4 is a top view illustrating a top structure of the heat exchanger of the first embodiment.

As shown in FIG. 4, the central axis m1 of the leeward first tank 11 and the central axis m2 of the windward first tank 21 are parallel to each other. Hereinafter, the X-axis direction parallel to both of the central axes m1, m2 are referred to as a "tank longitudinal direction X".

Figure 5:
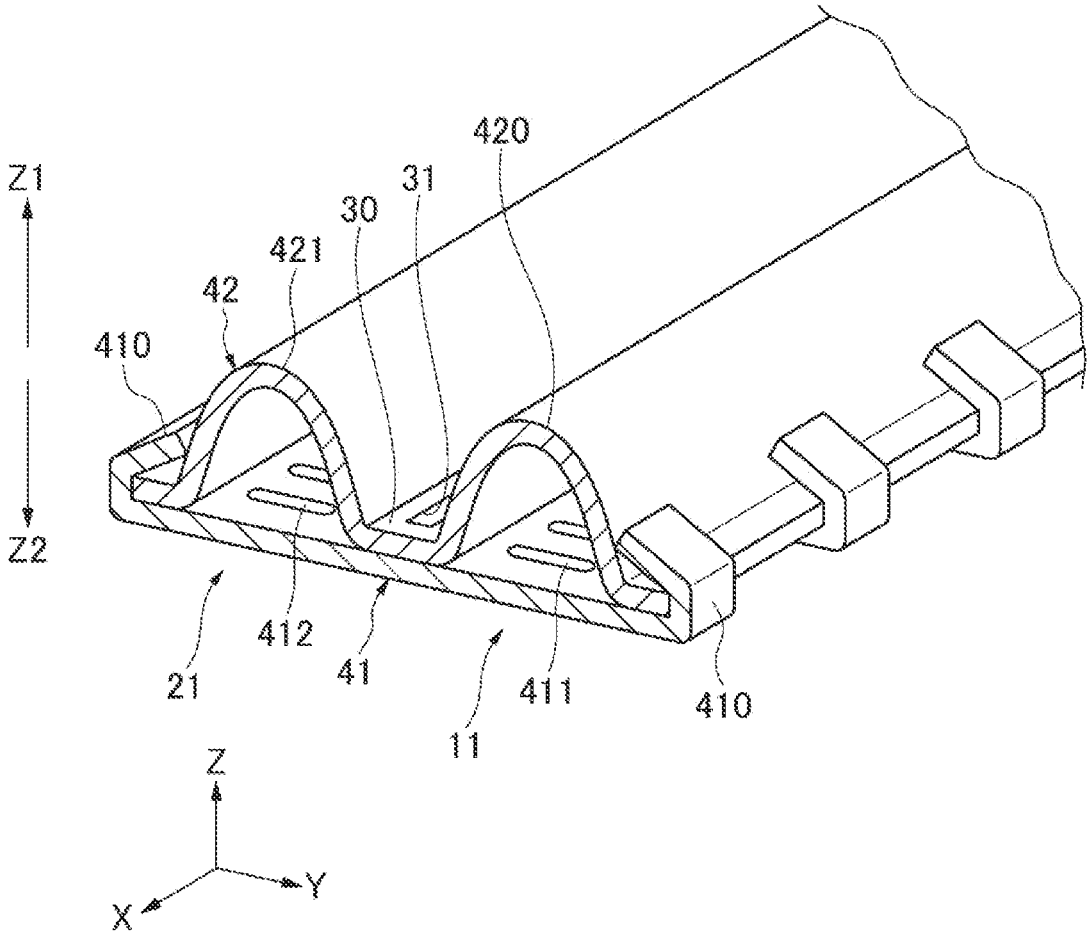
FIG. 5 is a cross-sectional view illustrating a cross-sectional structure of a leeward first tank and a windward first tank of the heat exchanger of the first embodiment.

As shown in FIG. 4, the leeward first tank 11 and the windward first tank 21 are connected to each other via a connecting portion 30. More specifically, as shown in FIG. 5, the leeward first tank 11 and the windward first tank 21 are formed of a first plate 41 and a second plate 42.

The first plate 41 has a flat shape, and is made of an aluminum alloy. The first plate 41 has first insertion holes 411 and second insertion holes 412 spaced apart from the first insertion holes 411 in a Y-axis direction. The first insertion holes 411 and the second insertion holes 412 are passing through the first plate 41 in a thickness direction of the first plate 41. The first insertion holes 411 are arranged at predetermined intervals in the tank longitudinal direction X. The upper ends of the tubes 120 of the leeward core 12 are inserted into and joined to the first insertion holes 411. Similarly, the second insertion holes 412 are arranged at predetermined intervals in the tank longitudinal direction X. The upper ends of the tubes 220 of the windward core 22 are inserted into and joined to the second insertion holes 412.

The second plate 42 is made of a flat-shaped aluminum alloy. The second plate 42 has been bent to have two peaks 420, 421. The two peaks 420, 421 protrude in the upward vertical direction Z1 and are elongated in the tank longitudinal direction X parallel to each other.

The first plate 41 is joined to a bottom surface of the second plate 42 by brazing. The first plate 41 has claws 410. The claws 410 are crimped to hold both edges of the second plate 42 in the air flow direction. In FIG. 4, the claws 410 are omitted.

In the heat exchanger 1 of the present embodiment, the leeward first tank 11 is formed of the first plate 41 and a peak 420 of the second plate 42 shown in FIG. 5. The windward first tank 21 is formed of the first plate 41 and a peak 421 of the second plate 42. The leeward first tank 11 and the windward first tank 21 are connected to each other via a joint 30. The joint 30 is a part that joints the first plate 41 and the second plate 42, and is arranged between the leeward first tank 11 and the windward first tank 21. In the present embodiment, the joint 30 corresponds to a connecting portion that connects the leeward first tank 11 and the windward first tank 21, and therefore the joint 30 is hereinafter referred to as a "connecting portion 30". The leeward first tank 11, the windward first tank 21, and the connecting portion 30 are provided upward of the leeward core 12 and the windward core 22 in the upward vertical direction Z1.

As shown in FIG. 4, the connecting portion 30 has slits 31. Each slit 31 is passing through the connecting portion 30 in the vertical direction Z. Each slit 31 is a rectangular through-hole, and a longitudinal direction of the slit 31 is parallel to the tank longitudinal direction X. The slits 31 are arranged at a predetermined slit interval W1 in the tank longitudinal direction X. Each slit 31 is arranged at a position overlapping with the tubes 120 of the leeward core 12 and the tubes 220 of the windward core 22 in the air flow direction Y. A length W2 of each slit 31 in the tank longitudinal direction X is longer than the slit interval W1.

A tank end surface 111 is defined as an end surface of the leeward first tank 11 opposite to a portion of the leeward first tank 11 connected to the connecting portion 30 in the air flow direction Y. The tubes 120 of the leeward core 12 is shifted from the connecting portion 30 toward the tank end surface 111 in the air flow direction Y. A shortest distance H12 is defined as a shortest distance from the tank end surface 111 of the leeward first tank 11 to an outline of each tube 120 in the air flow direction Y, and a shortest distance H11 is defined as a shortest distance from the slits 31 to the outline of the tube 120 in the air flow direction Y. The shortest distance H12 is longer than the shortest distance H11. A shortest distance H22 is defined as a shortest distance from a tank end surface 211 of the windward first tank 21 to an outline of each tube 220 in the air flow direction Y, and a shortest distance H21 is defined as a shortest distance from the slits 31 to the outline of the tube 220 in the air flow direction Y. The shortest distance H22 is longer than the shortest distance H21.

Next, an exemplary operation of the heat exchanger 1 of the present embodiment will be described.

In the heat exchanger 1 of the present embodiment, the heat medium flows as indicated by arrows in FIG. 1. That is, in the heat exchanger 1, when the heat medium flows into an internal space of the leeward first tank 11 from the inflow portion 110, the heat medium is distributed from the leeward first tank 11 to the tubes 120 of the leeward core 12. The heat medium flowing through each of the tubes 120 of the leeward core 12 is collected in the internal space of the leeward second tank 13 and then flows into the internal space of the windward second tank 23. The heat medium that has flowed into the internal space of the windward second tank 23 is distributed to the tubes 220 of the windward core 22, and then, collected in the windward first tank 21. The heat medium collected in the windward first tank 21 flows out from the outflow portion 210 to an outside.

In this heat exchanger 1, a high-temperature gas-phase heat medium or a high-temperature two-phase heat medium in which a gas-phase heat medium and a liquid-phase heat medium are mixed flows into the leeward first tank 11 through the inflow portion 110. The high-temperature heat medium that has flowed into the inflow portion 110 exchanges heat with an air when flowing through the tubes 120 of the leeward core 12 and the tubes 220 of the windward core 22, thereby releasing the heat to the air. As a result, the air is heated. On the other hand, the high-temperature gas-phase heat medium is cooled and transitions to a liquid-phase heat medium. Therefore, a proportion of the gas-phase heat medium to the liquid-phase heat medium increases in a downstream direction from the leeward first tank 11 toward the windward first tank 21. Most of the heat medium flowing through an internal space of the windward first tank 21 is in a low-temperature liquid phase.

Thus, in the heat exchanger 1, the heat medium flowing through the leeward first tank 11 is largely different in temperature from the heat medium flowing through the windward first tank 21, and the leeward first tank 11 and the windward first tank 21 are connected to each other. In this structure, since thermal strains occur in the tanks 11, 21, the tubes 120, 220 may be deformed.

Figure 6:
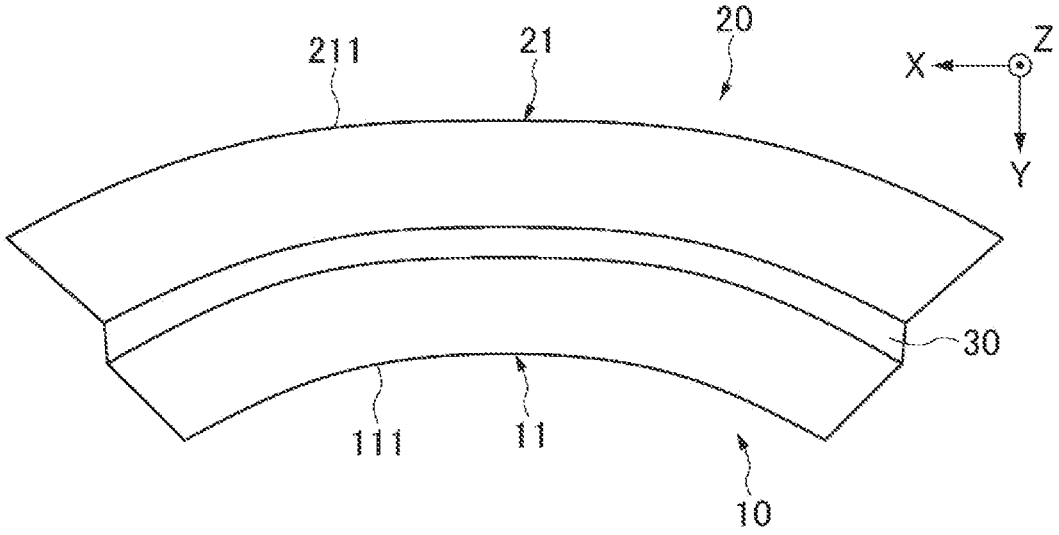
FIG. 6 is a top view schematically illustrating a deformation due to thermal strain of the top structure of the heat exchanger of the first embodiment.

In detail, the leeward first tank 11, in which the high-temperature heat medium flows, is thermally deformed such that the leeward first tank 11 expands in the tank longitudinal direction X, while the windward first tank 21, in which the low-temperature heat medium flows, is thermally deformed such that the windward first tank 21 shrinks in the tank longitudinal direction X. Thereby, as shown in FIG. 6, the leeward first tank 11 and the windward first tank 21 are deformed into an arch shape. It has been confirmed by the inventors' simulation analysis that the deformation of the tanks 11, 21 causes the stress concentration particularly on an inner regions A1, A2 of the tubes 120, 220 shown in FIG. 4. The tubes 120, 220 may be deformed due to the stress concentration in this inner regions A1, A2.

Contrary to this, as shown in FIGS. 4, 5, in the heat exchanger 1 of the present embodiment, since the slits 31 are formed in the connecting portion 30, when the tanks 11, 21 are deformed into an arch shape due to thermal strain, the slits 31 of the connecting portion 30 is capable of absorbing the difference in amount of deformation between the tanks 11, 21 in the air flow direction Y. Moreover, since the slits 31 are provided in the connecting portion 30, deformations of the tanks 11, 21 in the vertical direction Z, i.e., a longitudinal direction of the tubes 120, 220 are allowed, so that the tubes 120, 220 are less likely to be restrained by the tanks 11, 21 in the longitudinal direction of the tubes 120, 220. In this way, the difference in amount of deformation between the tanks 11, 21 is absorbed by the slits 31 in the connecting portion 30, and the tubes 120, 220 are less likely to be restrained by the tanks 11, 21. As a result, even when the tanks 11, 21 are deformed due to thermal strain, a stress is less likely to occur in the tubes 120, 220. Therefore, the stress concentration in the tubes 120, 220 can be reduced.

According to the heat exchanger 1 of the present embodiment described above, actions and effects described in the following items (1) to (5) can be obtained.

(1) Each slit 31 is formed in the connecting portion 30 that connects the leeward first tank 11 and the windward first tank 21 to each other. The slit 31 is passing through the connecting portion 30. According to this configuration, the slit 31 is capable of absorbing a difference in amount of deformation between the tanks 11, 21 due to thermal strain. Therefore, the stress concentration in the tubes 120, 220 can be reduced.

(2) As shown in FIG. 4, the length W2 of the slit 31 in the tank longitudinal direction X is longer than the slit interval W1 in the tank longitudinal direction X. According to this configuration, compared to a case where the length W2 of the slit 31 is shorter than the slit interval W1, the slit 31 is capable of absorbing more easily the difference in amount of deformation between the tanks 11, 21 due to thermal strain. As a result, the stress concentration in the tubes 120, 220 can be more accurately reduced.

(3) As shown in FIG. 6, when the tanks 11, 21 are deformed into an arch shape due to thermal strain, in the leeward first tank 11, an amount of deformation at a position near the tank end surface 111 is greater than an amount of deformation at a position near the connecting portion 30. Similarly, in the windward first tank 21 as well, an amount of deformation at a position near the tank end surface 211 is greater than an amount of deformation of at a position near the connecting portion 30. Regarding this, in the heat exchanger 1 of the present embodiment, as shown in FIG. 4, the shortest distance H12 from the tank end surface 111 of the leeward first tank 11 to an outline of each tube 120 in the air flow direction Y is longer than the shortest distance H11 from the slits 31 to the outline of the tube 120 in the air flow direction Y. The shortest distance H22 from the tank end surface 111 of the windward first tank 21 to an outline of each tube 220 in the air flow direction Y is longer than the shortest distance H21 from the slits 31 to the outline of the tube 220 in the air flow direction Y. According to this configuration, when the tanks 11, 21 are deformed into an arch shape due to thermal strain, the tubes 120, 220 can be avoided from being arranged in a portion where the amount of deformation is likely to increase. As a result, the stress concentration in the tubes 120, 220 can be more accurately reduced.

(4) Each slit 31 is arranged at a position overlapping with the tubes 120 of the leeward core 12 and the tubes 220 of the windward core 22 in the air flow direction Y. According to this configuration, since the slits 31 are arranged near the tubes 120, 220, the slits 31 can further reduce the stress concentration on the tubes 120, 220.

(5) The leeward first tank 11 and the windward first tank 21 are formed of the first plate 41 connected to the tubes 120 of the leeward core 12 and the tubes 220 of the windward core 22, and the second plate 42 fixed to the first plate 41. The first plate 41 and the second plate 42 define the internal space of the leeward first tank 11 and the internal space of the windward first tank 21. The first plate 41 and the second plate 42 form the connecting portion 30 between the internal space of the leeward first tank 11 and the internal space of the windward first tank 21. According to this configuration, since the connecting portion 30 connects the leeward first tank 11 and windward first tank 21, a connected structure can be easily realized.

Second Embodiment

Next, a heat exchanger 1 of a second embodiment will be described. Hereinafter, differences from the heat exchanger 1 of the first embodiment will be mainly described.

Figure 7:
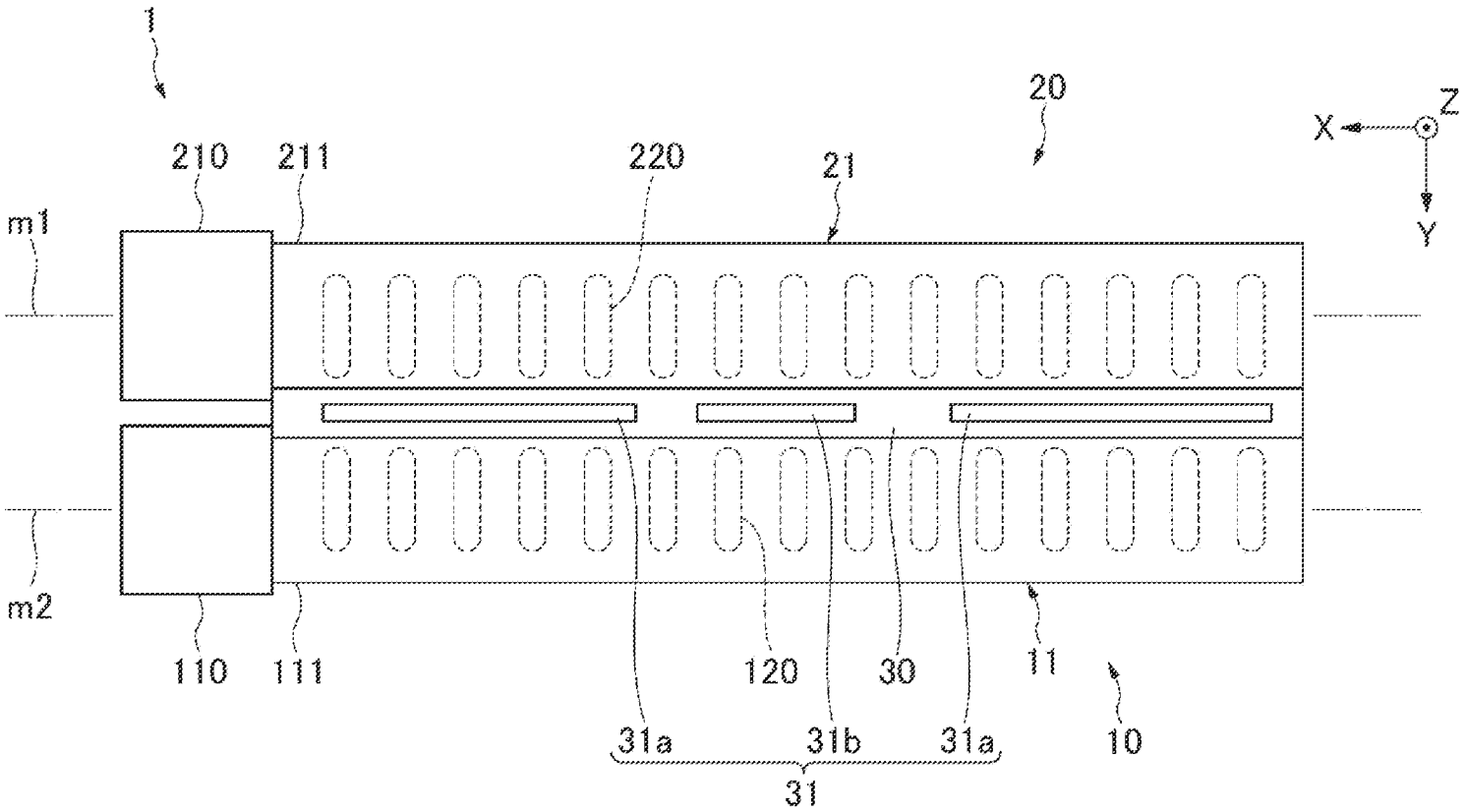
FIG. 7 is a top view illustrating a top structure of a heat exchanger of a second embodiment.

As shown in FIG. 7, in the heat exchanger 1 of the present embodiment, an end slit 31*a* and a central slit 31*b* have different lengths. More specifically, the end slit 31*a* is one of slits 31 and is provided at an end of a connecting portion 30 in a tank longitudinal direction X. The central slit 31*b* is one of the slits 31 and is provided between a center of the connecting portion 30 and the end slit 31*a* in the tank longitudinal direction X. A length of the end slit 31*a* in the tank longitudinal direction X is longer than a length of the central slit 31*b* in the tank longitudinal direction X.

According to the heat exchanger 1 of the present embodiment described above, actions and effects described in the following item (6) can be further obtained.

(6) When the tanks 11, 21 are deformed into an arch shape due to thermal strain, an amount of deformation at an end of each tank 11 21 is greater than an amount of deformation at a center of the tank 11, 21. Regarding this, in the heat exchanger 1 of the present embodiment, the length of the end slit 31*a* in the tank longitudinal direction X is longer than the length of the central slit 31*b* in the tank longitudinal direction X. In other words, the longer end slit 31*a* is arranged at a position where the amount of deformation is likely to increase at the time of the tanks 11, 21 being deformed into an arch shape due to thermal strain. As a result, the end slit 31*a* is capable of absorbing a difference in the amount of deformation of the tanks 11, 21. Therefore, the stress concentration in the tubes 120, 220 can be further reduced.

Third Embodiment

Next, a heat exchanger 1 of a third embodiment will be described. Hereinafter, differences from the heat exchanger 1 of the second embodiment will be mainly described.

Figure 8:
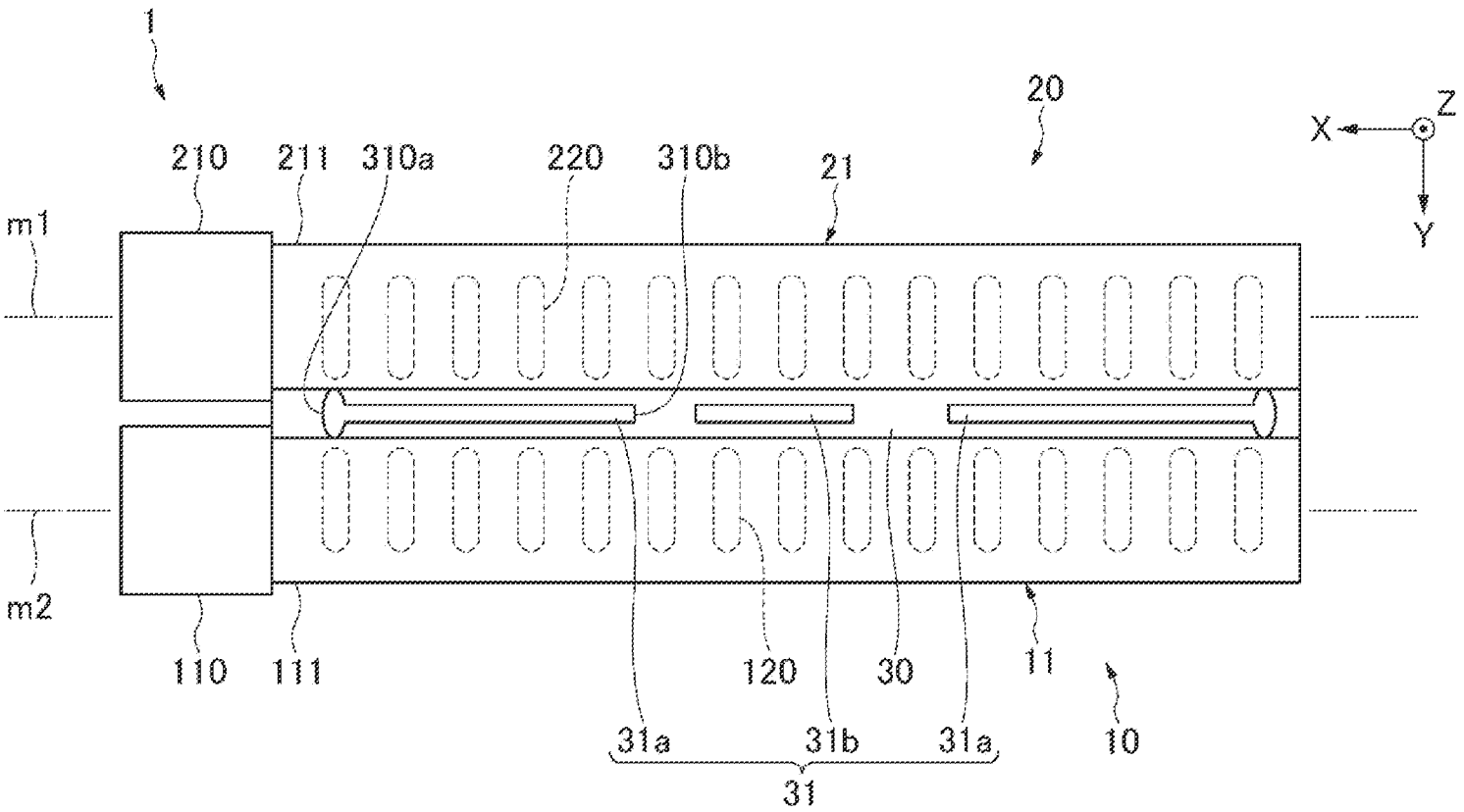
FIG. 8 is a top view illustrating a top structure of a heat exchanger of a third embodiment.

As shown in FIG. 8, in the heat exchanger 1 of the present embodiment, widths of opposite ends 310*a*, 310*b* of an end slit 31*a* in the tank longitudinal direction X are different. More specifically, the slit 31 has one end 310*a* and another end 310*b* that is opposite to the one end 310*a* in the tank longitudinal direction X. The one end 310*a* of the end slit 31*a* is located between an end of the connecting portion 30 and the other end 310*b* of the end slit 31*a*. The other end 310*b* of the end slit 31*a* in the tank longitudinal direction X is located between a center of the connecting portion 30 and the one end 310*a* of the end slit 31*a*. A width of the one end 310*a* in the air flow direction Y is longer than a width of the other end 310*b* in the air flow direction Y.

According to the heat exchanger 1 of the present embodiment described above, actions and effects described in the following item (7) can be further obtained.

(7) When the tanks 11, 21 are deformed into an arch shape due to thermal strain, an amount of deformation at an end of the tanks 11 21 is greater than an amount of deformation at a center of the tanks 11, 21. Regarding this, in the heat exchanger 1 of the present embodiment, the width of the one end 310*a* of the end slit 31*a* is longer than the width of the other end 310*b* of the end slit 31*a* In other words, the longer one end 310*a* of the end slit 31*a* is arranged at a position where the amount of deformation is likely to increase at the time of the tanks 11, 21 being deformed into an arch shape due to thermal strain. As a result, the end slit 31*a* is capable of absorbing a difference in amount of deformation between the tanks 11, 21. Therefore, the stress concentration in the tubes 120, 220 can be further reduced.

Fourth Embodiment

Next, a heat exchanger 1 of a fourth embodiment will be described. Hereinafter, differences from the heat exchanger 1 of the first embodiment will be mainly described.

Figure 9:
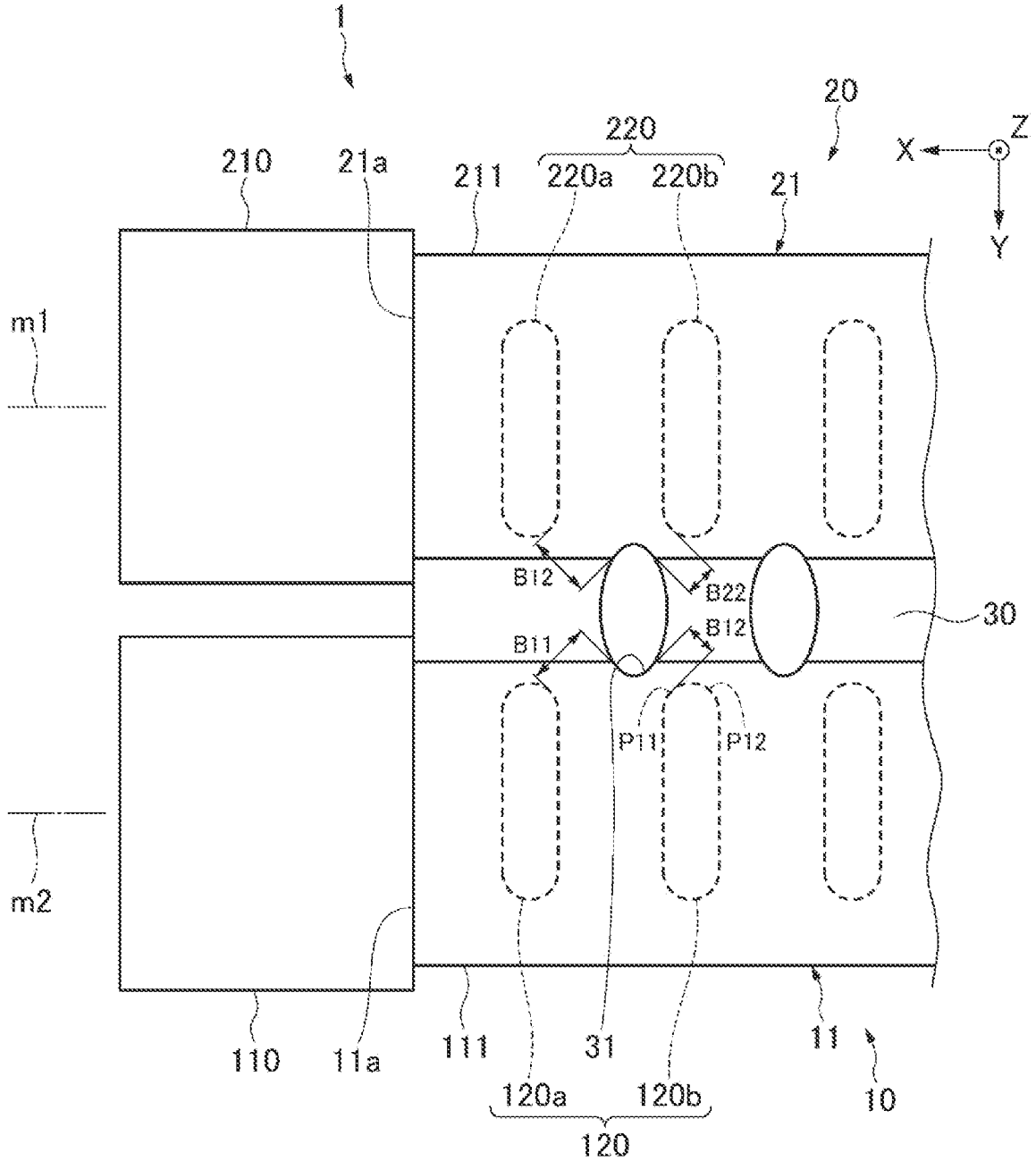
FIG. 9 is a top view illustrating a top structure of a heat exchanger of a fourth embodiment.

As shown in FIG. 9, in the heat exchanger 1 of the present embodiment, each slit 31 has an elliptical shape, and the slit 31 is arranged between two adjacent tubes 120*a*, 120*b* of a leeward core 12 in a tank longitudinal direction X. A tube 120*a* is one of the two adjacent tubes 120*a*, 120*b*, and is arranged between an end 11*a* of a leeward first tank 11 in the tank longitudinal direction X and another of the two adjacent tubes 120*a*, 120*b*. A tube 120*b* is the other of the two adjacent tubes 120*a*, 120*b*, and is arranged between a center of the leeward first tank 11 in the tank longitudinal direction X and the one of the two adjacent tubes 120*a*, 120*b*. A shortest distance B11 between the tube 120*a* and the slit 31 is longer than a shortest distance B12 between the tube 120*b* and the slit 31.

The slit 31 is arranged between two adjacent tubes 220*a*, 220*b* of the windward core 22 in the tank longitudinal direction X. A tube 220*a* is one of the two adjacent tubes 120*a*, 220*b*, and is arranged between an end 21*a* of a windward first tank 21 in the tank longitudinal direction X and another of the two adjacent tubes 220*a*, 220*b*. A tube 220*b* is the other of the two adjacent tubes 220*a*, 220*b*, and is arranged between a center of the windward first tank 21 in the tank longitudinal direction X and the one of the two adjacent tubes 220*a*, 220*b*. A shortest distance B21 between the tube 220*a* and the slit 31 is longer than a shortest distance B22 between the tube 220*b* and the slit 31.

In the present embodiment, the tube 120*a*, 220*a* corresponds to a first tube, and the tube 120*b*, 220*b* corresponds to a second tube.

According to the heat exchanger 1 of the present embodiment described above, actions and effects described in the following item (8) can be further obtained.

(8) An inside of a tube 120 near to the connecting portion 30 has a portion P11 and a portion P22 inside of the tube 120 as shown in FIG. 9. An amount of deformation in the portion P11 is greater than an amount of deformation in the portion P12 when the tanks 11, 21 are deformed into an arch shape due to thermal strain. The portion P11 is arranged between the end 11*a* of the leeward first tank 11 and the portion P22 in the inside of the tube 120. The portion P12 is arranged between the center of the leeward first tank 11 and the portion P11 in the inside portion of the tube 120. In the heat exchanger 1 of the present embodiment, the shortest distance B11 between the tube 120*a* and the slit 31 is longer than the shortest distance B12 between the tube 120*b* and the slit 31. In other words, the slit 31 is arranged near to a portion of the tube 120 where the amount of deformation is more likely to increase. Therefore, the stress concentration in the tubes 120 can be further reduced. In addition, the similar operational effects can be obtained in the tubes 220.

Other Embodiments

The preceding embodiments may be practiced in the following embodiments.

Figure 10:
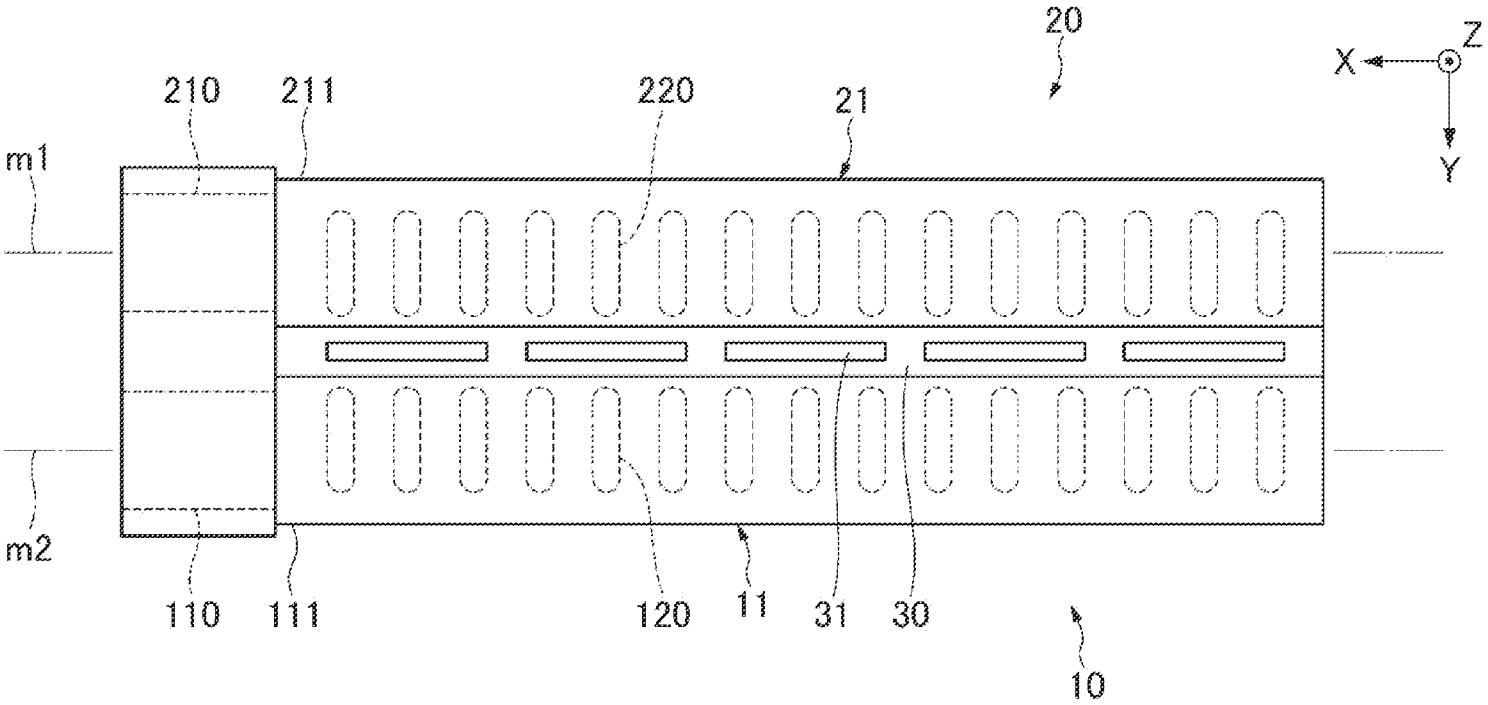
FIG. 10 is a top view illustrating a top structure of a heat exchanger of another embodiment.

As shown in FIG. 10, the inflow portion 110 of the leeward first tank 11 and the outflow portion 210 of the windward first tank 21 may be integrally formed. In the heat exchanger 1, a temperature difference is the largest between the inflow portion 110 through which the high-temperature heat medium flows in and the outflow portion 210 through which the low-temperature heat medium flows out. Therefore, when the inflow portion 110 and the outflow portion 210 are arranged adjacent to each other, the thermal strain generated in them may be the largest. Regarding this, as shown in FIG. 10, since the inflow portion 110 and the outflow portion 210 are integrally formed, a rigidity thereof can be increased. As a result, deformations of the inflow portion 110 and the outflow portion 210 due to the thermal strain can be reduced. As a result, deformations of the tanks 11, 21 due to the thermal strain can be reduced, and therefore, the stress concentration in the tubes 120 can be further reduced.

Figure 11:
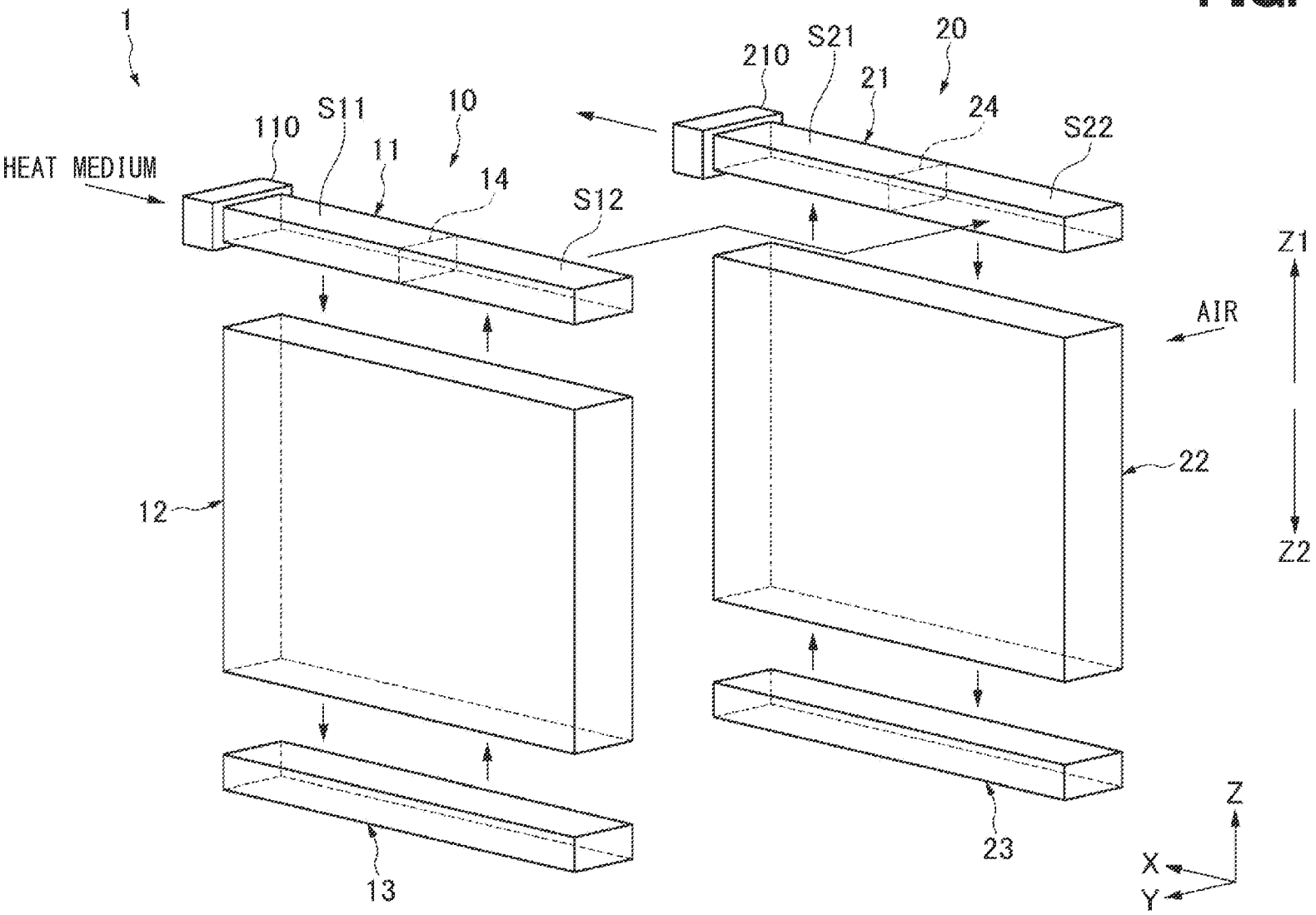
FIG. 11 is a diagram schematically illustrating a configuration of a heat exchanger according to another embodiment.
Figure 12:
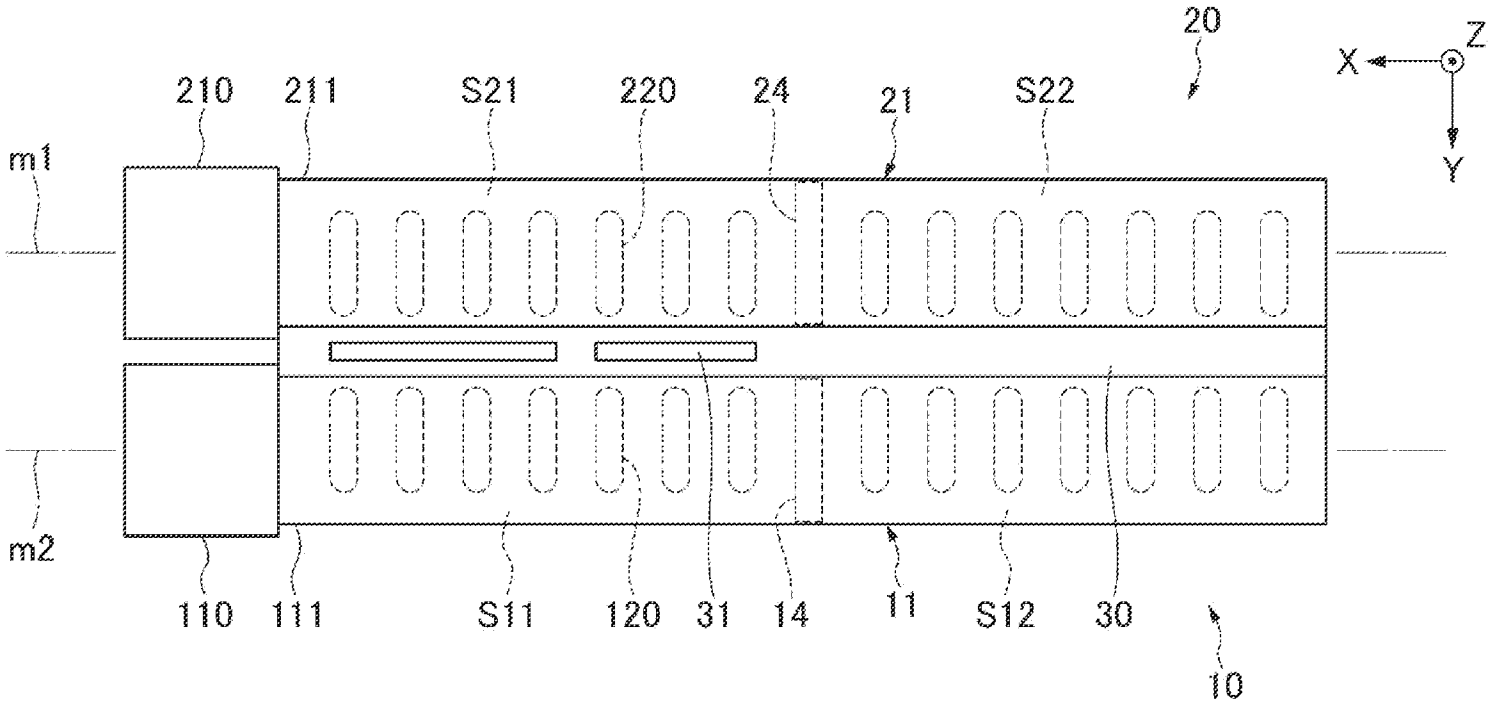
FIG. 12 is a top view illustrating a top structure of a heat exchanger of another embodiment.

In the heat exchanger 1 of each embodiment, the flow of the heat medium may be changed as appropriate. For example, in a heat exchanger 1 shown in FIG. 11, the leeward first tank 11 and the windward first tank 21 may have partition walls 14, 24, respectively, and the flow path of the heat medium may be a U-shape in the leeward heat-exchange portion 10 and the windward heat-exchange portion 20. In the heat exchanger 1, the high-temperature heat medium flows from the inflow portion 110 into one internal space S11 among two internal spaces S11, S12 partitioned by a partition wall 14 in the leeward first tank 11. Further, the low-temperature heat medium flows out from the outflow portion 210 through one internal space S21 among two internal spaces S21, S22 partitioned by a partition wall 24 in the windward first tank 21. In this configuration, the thermal strain is particularly likely to be generated between the internal space S11 of the leeward first tank 11 is and the internal space S21 of the windward first tank 21. Therefore, as shown in FIG. 12, a slit 31 may be provided only in a portion of the connecting portion 30 interposed between the internal space S11 of the leeward first tank 11 and the internal space S21 of the windward first tank 21.

The structure of each tank 11, 21 of each embodiment is not limited to the structure shown in FIG. 5, and can be appropriately changed. For example, the leeward first tank 11 and the windward first tank 21 may be formed of different members, and the connecting portion 30 made of another member different from them may be joined to the tanks 11, 21 by brazing. Alternatively, the leeward first tank 11 and the windward first tank 21 may be directly joined by brazing, and then the connecting portion 30 may be made of the brazed joint. In either structure, a heat exchanger in which the tanks 11, 21 are connected to each other via the connecting portion 30 can be realized.

The tubes 120 of the leeward core 12, the tubes 220 of the windward core 22, or both the tubes 120 of the leeward core 12 and the tubes 220 of the windward core 22 include a tube positioned without overlapping the slits 31 in the air flow direction Y.

Figure 13:
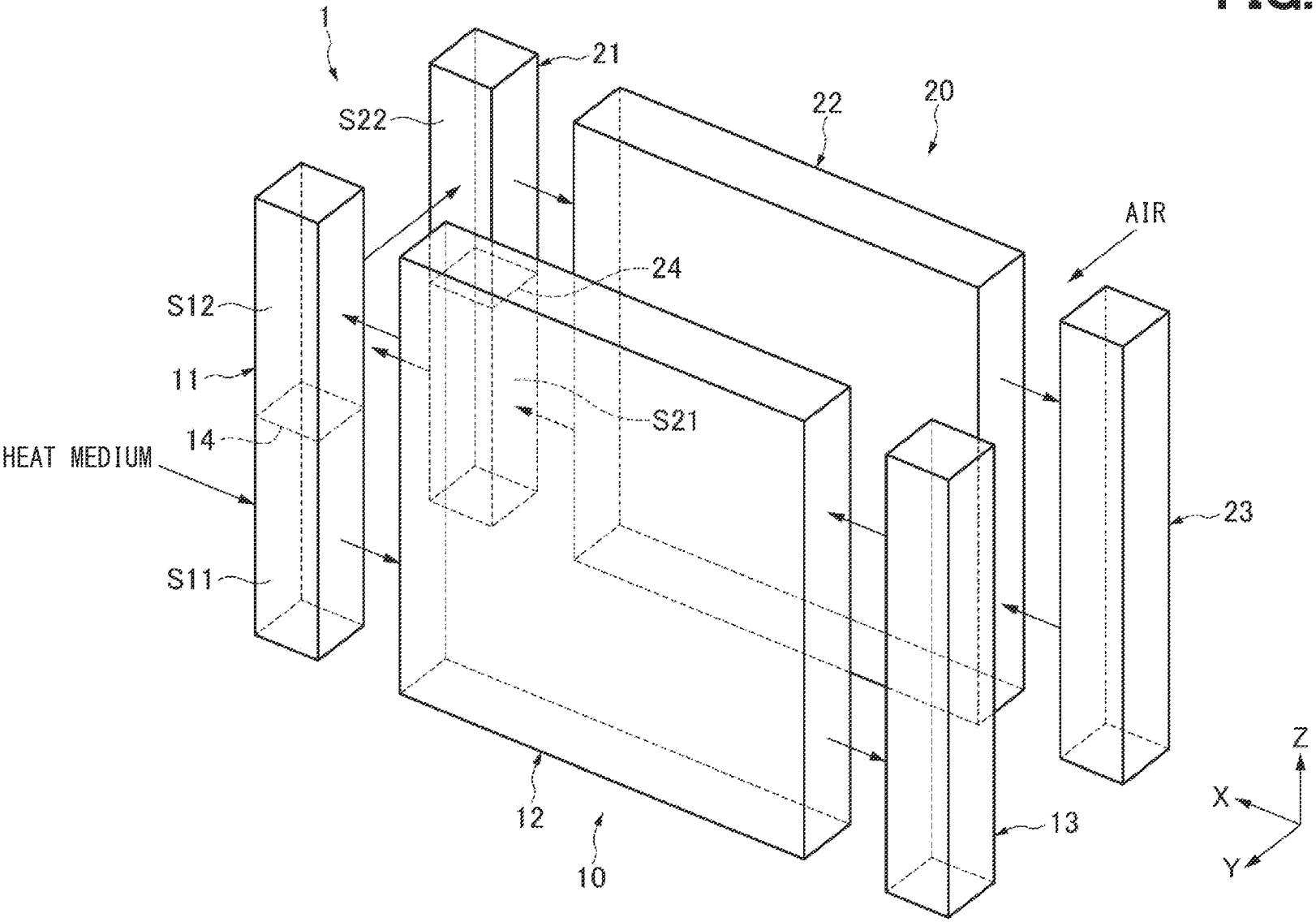
FIG. 13 is a diagram schematically illustrating a configuration of a heat exchanger according to another embodiment.
Figure 14:
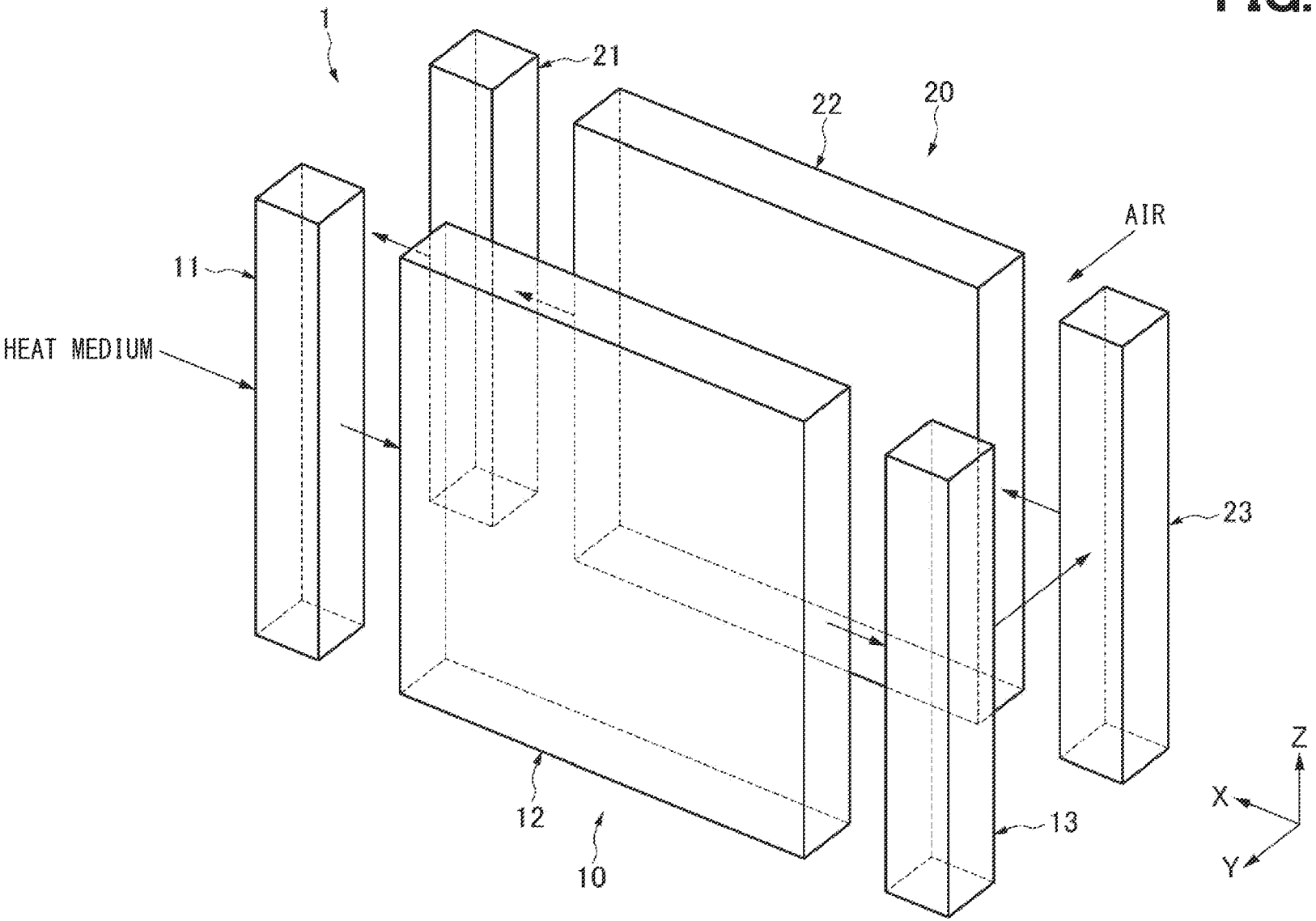
FIG. 14 is a diagram schematically illustrating a configuration of a heat exchanger according to another embodiment.

The structures of the leeward heat-exchange portion 10 and the windward heat-exchange portion 20 of each embodiment can be appropriately changed. For example, as shown in FIGS. 13 and 14, the leeward heat-exchange portion 10 may have tanks 11, 13 at opposite ends of the leeward core 12 in the X-axis direction. Also, the windward heat-exchange portion 20 may have tanks 21, 23 at opposite ends of the windward core 22 in the X-axis direction.

Figure 15:
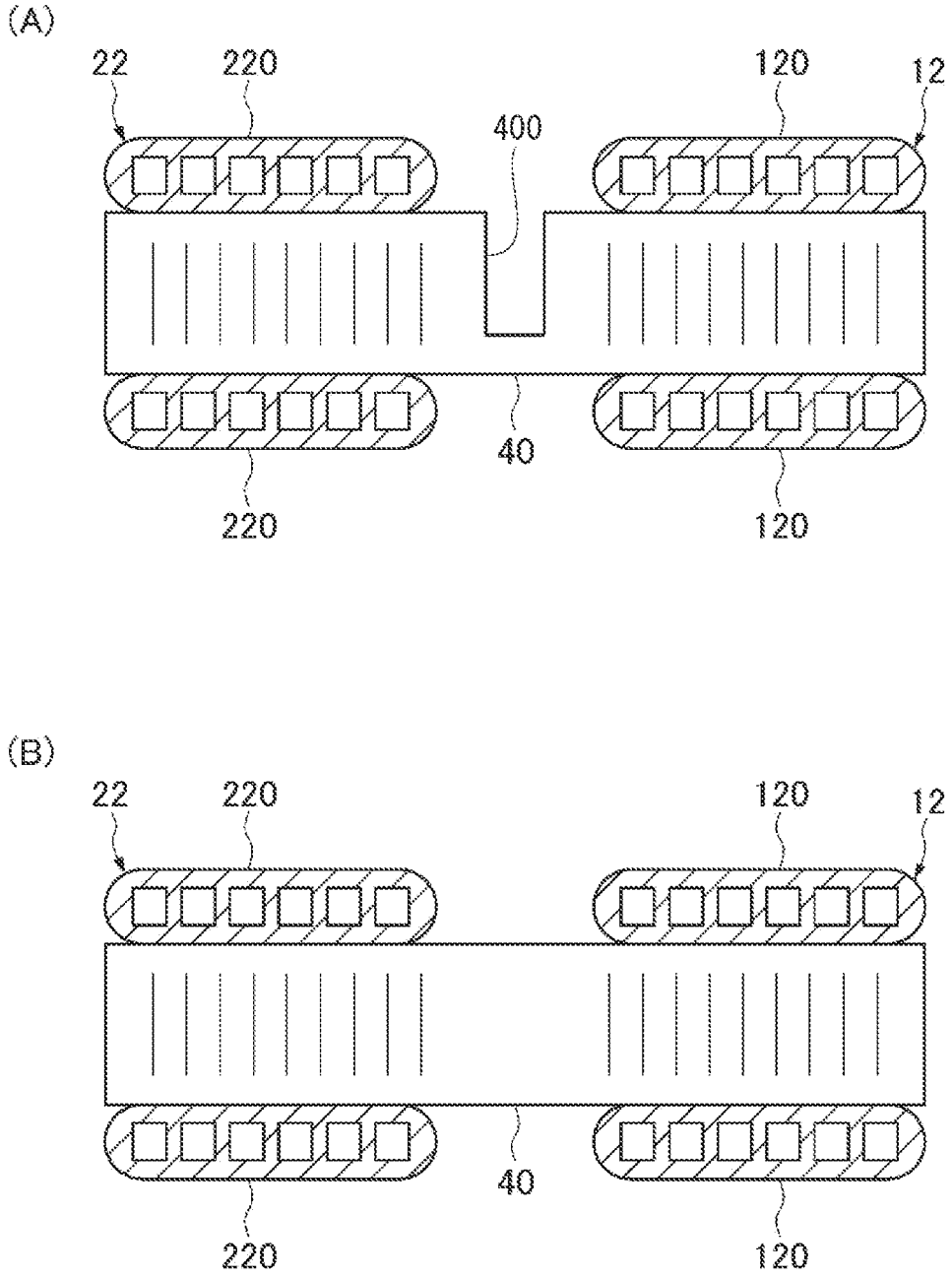
FIG. 15 is (A) a cross-sectional view illustrating a cross-sectional structure of a heat exchanger of another embodiment, and (B) a cross-sectional view illustrating a cross-sectional structure of a heat exchanger of another embodiment.

As shown in FIGS. 15(A) and 15(B), the tubes 220 of the windward core 22 and the tubes 120 of the leeward core 12 may be connected to each other via fins 40. Further, as shown in FIG. 15(A), a slit 400 may be formed in the fins 40. According to this configuration, the fins 40 are capable of restraining expansion and shrink of the tubes 120, 220. As a result, the thermal strain of the tanks 11, 21 can be reduced.

While the present disclosure has been described with reference to embodiments thereof, it is to be understood that the disclosure is not limited to the embodiments and constructions. To the contrary, the present disclosure is intended to cover various modification and equivalent arrangements. In addition, while the various elements are shown in various combinations and configurations, which are exemplary, other combinations and configurations, including more, less or only a single element, are also within the spirit and scope of the present disclosure.

What is claimed is:

1. A heat exchanger for heat exchange between heat medium flowing inside the heat exchanger and air flowing outside the heat exchanger, the heat exchanger comprising a first heat-exchange portion and a second heat-exchange portion that are arranged facing each other in an air flow direction, and are connected to allow the heat medium to flow between the first heat-exchange portion and the second heat-exchange portion, wherein the first heat-exchange portion includes a first core having a stacked structure of tubes through which the heat medium flows, and a first header tank connected to ends of the tubes of the first core and having an inflow portion through which the heat medium flows into the first heat-exchange portion, the second heat-exchange portion includes a second core having a stacked structure of tubes through which the heat medium flows, and a second header tank connected to ends of the tubes of the second core and having an outflow portion through which the heat medium flows out of the second heat-exchange portion, the first header tank allows a gas-phase heat medium to flow through the first header tank, the second header tank allows a liquid-phase heat medium to flow through the second header tank, the liquid-phase heat medium is lower in temperature than the gas-phase heat medium flowing through the first header tank, the first header tank and the second header tank are connected to each other via a connecting portion, the connecting portion has a slit passing through the connecting portion, a tank longitudinal direction is defined as a direction parallel to both a central axis of the first header tank and a central axis of the second header tank, the slit is one of slits arranged side by side in the connecting portion at a predetermined slit interval in the tank longitudinal direction, and a length of each of the slits in the tank longitudinal direction is longer than a length of the slit interval in the tank longitudinal direction.

2. The heat exchanger according to claim 1, wherein the first header tank and the second header tank each have more than two parts connected by the connecting portion, and the more than two parts are located at positions where an internal space of the first header tank through which the gas-phase heat medium flows and an internal space of the second header tank through which the liquid-phase heat medium flows overlap each other in the air flow direction.

3. The heat exchanger according to claim 1, further comprising a fin connecting the first core and the second core.

4. The heat exchanger according to claim 1, wherein the first header tank, the second header tank, and the connecting portion are provided upward of the first core and the second core in a vertical direction.

5. The heat exchanger according to claim 1, further comprising a first plate and a second plate which form the first header tank and the second header tank, wherein the first plate is connected to the tubes of the first core and the tubes of the second core, the second plate is fixed to the first plate, the first plate and the second plate define an internal space of the first header tank and an internal space of the second header tank, and the first plate and the second plate form the connecting portion between the internal space of the first header tank and the internal space of the second header tank.

6. The heat exchanger according to claim 1, wherein the inflow portion and the outflow portion are integrally formed.

* * * * *